US006452105B2

(12) United States Patent
Badii et al.

(10) Patent No.: US 6,452,105 B2
(45) Date of Patent: Sep. 17, 2002

(54) COAXIAL CABLE ASSEMBLY WITH A DISCONTINUOUS OUTER JACKET

(75) Inventors: Vahid Badii, Chatsworth; Farzad Kialashaki, Thousand Oaks, both of CA (US)

(73) Assignee: Meggitt Safety Systems, INc., Simi Valley, CA (US)

( * ) Notice: Subject to any disclaimer, the term of this patent is extended or adjusted under 35 U.S.C. 154(b) by 0 days.

(21) Appl. No.: 09/760,253

(22) Filed: Jan. 12, 2001

Related U.S. Application Data

(60) Provisional application No. 60/175,662, filed on Jan. 12, 2000.

(51) Int. Cl.[7] ..... H01B 7/00

(52) U.S. Cl. ..... 174/102 R; 174/102 SC; 174/28

(58) Field of Search ..... 174/74 R, 75 C, 174/77 R, 84 R, 88 C, 88 R, 28, 102 R, 102 SP, 109

(56) References Cited

U.S. PATENT DOCUMENTS 3,458,648 A * 7/1969 Volker ..... 174/88
3,613,050 A * 10/1971 Andrews ..... 339/177 R
3,778,526 A 12/1973 Floessel
3,970,969 A * 7/1976 Sirel et al. ..... 333/12
4,011,118 A 3/1977 Geominy
4,144,404 A * 3/1979 De Groef et al. ..... 174/88 C
4,173,386 A * 11/1979 Kauffman et al. ..... 339/177 R
4,487,660 A 12/1984 Netzel et al.
4,619,496 A * 10/1986 Forney, Jr. et al. ..... 339/177 R
4,667,061 A 5/1987 Ishikawa et al.
4,698,458 A * 10/1987 Parmigiani et al. ..... 174/73 R
5,329,262 A * 7/1994 Fisher, Jr. ..... 333/33
5,742,002 A 4/1998 Arredondo et al.
5,990,419 A 11/1999 Bogese, II
6,207,901 B1 * 3/2001 Smith et al. ..... 174/102 R

* cited by examiner

*Primary Examiner*—Dean A. Reichard
*Assistant Examiner*—William H. Mayo, III
(74) *Attorney, Agent, or Firm*—Bissell & Bissell; Henry M. Bissell, III; Henry M. Bissell, IV

(57) ABSTRACT

A coaxial cable structure incorporating a physical interruption in the outer jacket or sheath of the cable. This interrupts the continuity of the outer conductor and serves to block DC (direct current) and low frequency electrical signals. Also, it greatly reduces heat transmission along the cable. The interruption is achieved by placing a specially fabricated stub in series with the coaxial cable. The resulting coaxial cable assembly acts like a band-pass filter which, although blocking DC and lower frequency electrical signals, is able to transmit RF (radio frequency) signals at selected frequencies. The entire assembly, including the stub, can be made hermetic.

22 Claims, 1 Drawing Sheet

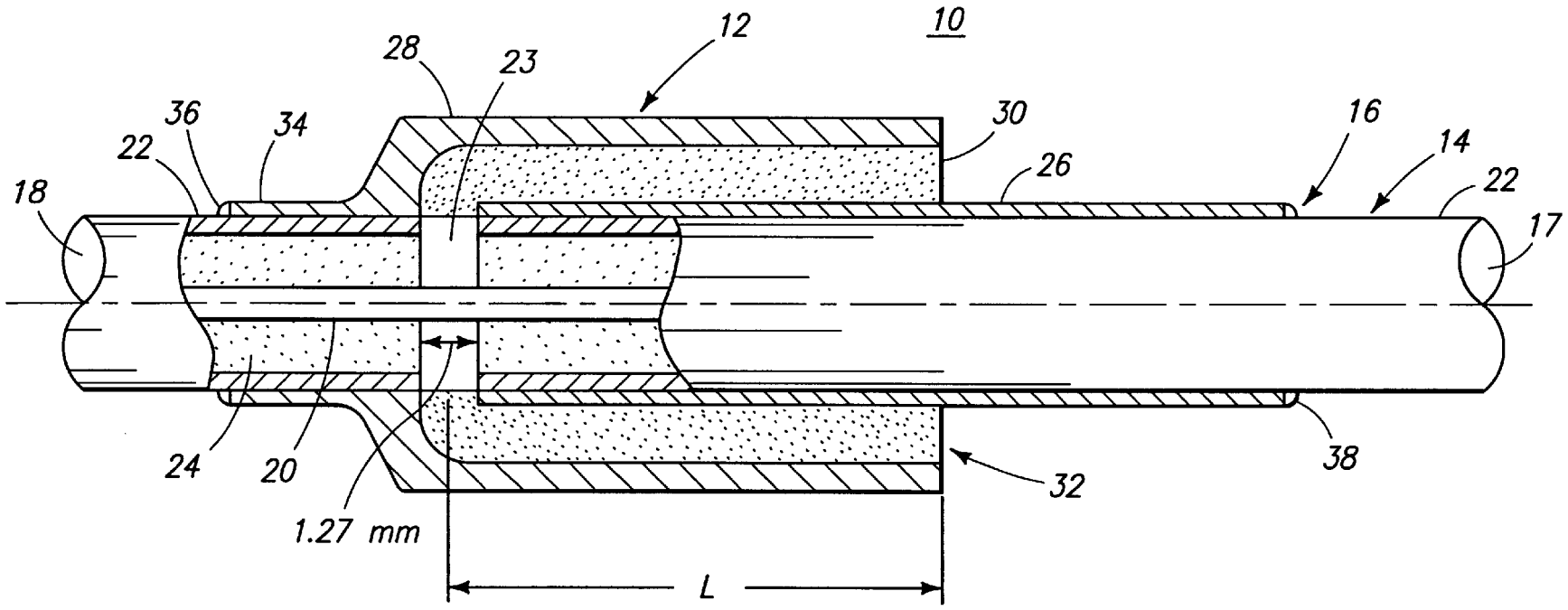
10
12
14
16
17
18
20
22
22
23
24
26
28
30
32
34
36
38
L
1.27 mm

COAXIAL CABLE ASSEMBLY WITH A DISCONTINUOUS OUTER JACKET

CROSS-REFERENCE TO RELATED APPLICATION

This application claims the benefit of U.S. Provisional Application No.: 60/175,662, filed Jan. 12, 2000.

BACKGROUND OF THE INVENTION

1. Field of the Invention

The present invention generally relates to electrical conductors and, more particularly, to coaxial cables for conducting relatively high frequency signals.

2. Description of the Related Art

There are known in the art certain connectors for coaxial cables which are commonly referred to as "DC Blocks". These connectors are constructed to be located at an end of the cable assembly, which significantly restricts their utility and bars their use from applications to which the present invention is readily adapted. DC blocks are commonly used to eliminate ground loops, and to isolate sensitive electronics from adverse electromagnetic interference. Such DC Block connectors as are known are incapable of providing thermal or electrical separation in a hostile environment and they are not hermetic, as are embodiments of the present invention.

Certain patents of which the inventors are aware disclose gas-filled insulated casings for high voltage conductors which may superficially appear similar to embodiments of the present invention. Examples are found in U.S. Pat. No. 3,778,526 of Floessel, U.S. Pat. No. 4,011,118 of Geominy, U.S. Pat. No. 4,487,660 of Netzel et al. and U.S. Pat. No. 4,667,061 of Ishikawa et al. An air-dielectric coaxial cable with hollow spacer element is the subject of U.S. Pat. No. 5,742,002 of Arredondo et al. None of these disclosures is particularly relevant to the present invention for the reason that none of them shows a physical interruption in the outer conductor or sheath of the cable.

A data cable is disclosed in U.S. Pat. No. 5,990,419 of Bogese, II which comprises a single conductor cable with specially configured insulation; it is not a coaxial cable.

SUMMARY OF THE INVENTION

In brief, one particular arrangement in accordance with the present invention comprises a stub which is fabricated with a sleeve formed of two conductors that slide snugly onto the associated coaxial cable,in the complete assembly. The sleeve is in two parts with a dielectric insulation between them. One of the sleeves has an overlapping section of larger diameter and the dielectric insulation extends within this section between the two sleeve portions. The larger diameter section is necked down at the butt end of the stub to match the outer diameter of the coaxial cable and, at this point, the dielectric insulation extends into the space between the two sleeve portions at the surface of the coaxial cable. The sheath and dielectric insulation of the coaxial cable are cut and removed at the point where the space between the two sleeves of the stub is positioned. This results in a blockage of DC (direct current) and low frequency signals as well as thermal energy.

The electrical length of the stub is chosen such that it is equal to a quarter wavelength at the chosen frequency of operation. To achieve this condition, a series stub with an input impedance of zero ohms is used. Thus the stub terminates in an open circuit, thereby providing the physical separation desired. The stub has an impedance of infinity at the open end, which transforms to zero ohms at the junction with the coaxial cable. Therefore, at the operating frequency, the stub is transparent to the signal flowing in the cable assembly. However DC and lower frequencies of electrical signals are blocked.

In a preferred embodiment of the invention, in which the cable assembly has a chosen operating frequency of 4 GHz, the stub has a dielectric insulation of commercially available 7070 glass. Other insulation materials may be used to meet special requirements for thermal energy flow and power handling.

The most important variable in the structure of the invention is the length of the series stub. Once the dielectric material is chosen and the frequency of operation is determined, the length of the stub is found by the following equation:

$$L=0.075/(f(\in_r)^{0.5})$$

where f is frequency in GHz, $\in_r$ is the dielectric constant of the insulation used in the stub, and L is the stub length in meters.

Once the stub length is determined, the respective internal and external sleeve conductors can be fabricated. The external conductor is preferably made about 10% longer than the other conductor to allow for later adjustment. The space between the conductors is filled with the selected dielectric insulation. The shell is then fired to allow the dielectric to fill any gaps or voids and bond with the conductors to form a hermetic seal.

Next a section of the coaxial cable assembly is prepared by stripping a length of 1.27 mm from the outer conductor (shell) at the location where the;discontinuity is needed. The dielectric in that section may also be removed, although the center conductor is maintained intact.

After preparation of the chosen section of the coaxial cable as described, the stub is then slid onto the cable up to the stripped section. The stub is positioned so that the discontinuity of the coaxial sheath is located under the dielectric opening in the stub. The stub can then be welded to the outer jacket of the coaxial cable.

The length L in the formula above is measured from the midpoint of the gap or discontinuity in the coaxial cable. The thickness of the dielectric in the stub equals the length of this gap; the space between the two sleeve portions of the stub corresponds to the gap in the cable sheath. The material of the gap is not critical; it may be air or some other dielectric, depending upon the makeup of the ambient atmosphere in which the components are assembled. Alternatively, the gap may contain the insulation material of the cable if the material is not removed during removal of the portion of the sheath at the gap. The stub is now welded to the outer jacket of the coaxial cable. Connectors can be welded at both ends of the cable to complete the cable assembly.

The shell portion of the stub at the open end extends beyond the point of ideal length for the stub. This is to permit later adjustment after the stub is in proper position on the coaxial cable. At this point, the voltage standing wave ratio of the electrical signal as it travels through the cable assembly is measured with a network analyzer and stub length is adjusted as needed. Usually the outer conductor is longer than necessary and the stub can be shortened until the best voltage standing wave ratio at the desired operating frequency is achieved.

BRIEF DESCRIPTION OF THE DRAWING

A better understanding of the present invention may be realized from a consideration of the following detailed description, taken in conjunction with the accompanying drawing, in which:

The single FIGURE is a side sectional view, partially broken away, of a cable assembly in accordance with the present invention.

DESCRIPTION OF THE PREFERRED EMBODIMENT

As shown in the accompanying drawing, partially cutaway, the sole figure depicts a cable assembly 10 comprising a stub 12 in position on a portion of coaxial cable 14. As indicated by the pictorial terminations 17 and 18, the cable 14 has no definite end in either direction.

Depicted in the cutaway portion of the cable 14 are a central conductor 20 and an outer sheath 22, between which is the insulation 24. The coaxial cable is conventional in its construction.

The stub 12 comprises an internal conductor 26 and an outer conductor 28 spaced apart by a dielectric 30. This dielectric 30 is shown extending from the open end 32 of the stub 12 to the point where the sheath 22 of the coaxial cable is interrupted at the gap 23. The length L of the stub according to the formula hereinabove, is measured from the midpoint of the gap 23 to the open end 32 of the stub. At the butt end 34 of the stub 12, remote from the open end 32, the external conductor 28 is necked down to match the outer diameter of the cable sheath 22. This portion is welded to the sheath 22, as indicated by fillet 36 which extends around the end of the necked-down portion 34. The internal conductor 26 of the stub 12 is similarly welded to the cable sheath 22 at point 16 by fillet 38 which extends circumferentially about the sheath 22. After the weld fillets 36 and 38 are set, the proper length of the stub 12 is adjusted by trimming the stub at the open end 32 in accordance with measurements of standing wave ratio by a network analyzer.

In one particular embodiment, the length of the gap is 1.27 mm. The dielectric insulation 30 of the stub 12 is commercially available 7070 glass, fired to make the stub hermetic.

Although there have been described hereinabove various specific arrangements of a COAXIAL CABLE ASSEMBLY WITH A DISCONTINUOUS OUTER JACKET in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the present invention.

What is claimed is:

1. A coaxial cable assembly with a discontinuous outer jacket, said assembly comprising:

a coaxial cable having a central conductor, an outer conducting sheath, and insulation material disposed therebetween, a section of said coaxial cable having a portion of its outer sheath removed to expose the central conductor along a gap having a selected length; and a stub having an internal conductor, an outer conductor, and a dielectric material separating said internal and outer conductors, said stub having an effective electrical length of a predetermined value;

said outer conductor having a section of enlarged diameter overlapping a portion of said internal conductor and a necked-down section remote from the enlarged diameter section, said overlapped portion of the stub internal conductor and said necked-down section being adapted to match the outer diameter of the coaxial cable outer sheath;

said outer conductor and said internal conductor of the stub being electrically connected to said outer sheath of said coaxial cable on opposite sides of said gap;

whereby said stub is secured in a position along said coaxial cable such that one end of the dielectric material of said stub is positioned over said gap in the coaxial cable.

2. The coaxial cable assembly of claim 1 wherein said stub has a length L, measured from the midpoint of said gap to the end of the stub remote from said gap, whereby said length L is adjusted in accordance with measurements of standing wave ratio of the transmitted signal of said cable.

3. The coaxial cable assembly of claim 2 wherein the length of the stub is equal to a quarter wavelength at a selected operating frequency.

4. The coaxial cable assembly of claim 3, wherein said stub has the impedance of an open circuit at its open end transforming to zero ohms at the end of said stub positioned over said gap, whereby at the selected operating frequency said gap is transparent to signals at said selected operating frequency while effectively blocking DC and lower frequency signals.

5. The coaxial cable assembly of claim 1, wherein said gap approximately 1.27 mm in length.

6. The coaxial cable assembly of claim 1, wherein said dielectric material comprises commercially available 7070 glass, fired to make the stub hermetic.

7. A coaxial cable assembly with a discontinuous outer jacket, said assembly comprising:

a coaxial cable having a continuous central conductor, an outer conducting sheath, and insulation material disposed therebetween, with portions of both the outer sheath and said insulation material removed to form a gap having a predetermined length;

a quarter wavelength stub electrically connected to said outer conducting sheath and bridging said gap, said stub having inner and outer conducting sleeves with dielectric material therebetween, said outer conducting sleeve having a section of enlarged diameter overlapping a portion of said inner conducting sleeve and a necked-down section of reduced diameter adapted to match the outer diameter of the coaxial cable outer sheath;

whereby an open circuit end of said stub transforms to a closed circuit at said gap for signal frequencies in a limited range about a coaxial cable transmission frequency such that DC, signal frequencies below said range and thermal energy are blocked by said gap.

8. The coaxial cable assembly of claim 7 wherein the stub is electrically connected to the coaxial cable sheath by welds between the respective sleeve portions and the outer sheath of the coaxial cable.

9. The coaxial cable assembly of claim 7 wherein said stub is formed to establish: an electrical length of the stub equal to a quarter wavelength at a selected frequency of operation.

10. The coaxial cable assembly of claim 9 wherein the length of the stub in meters is established in accordance with the following equation:

$$L=0.075/(f(\in_r)^{0.5})$$

where f is the operating frequency in GHz, and $\in_r$ is the dielectric constant of the stub dielectric material.

11. The coaxial cable assembly of claim 10 wherein the selected frequency of operation is 4 GHz and the dielectric insulation of the stub is commercially available 7070 glass.

12. In combination:

a coaxial cable comprising an outer jacket, a central conductor, and insulation between the outer jacket and the central conductor, said cable having a discontinuity in its outer jacket and the insulation forming an open circuit gap along said cable; and a quarter wavelength stub having an electrical length of a quarter wave at a selected transmission frequency;

the stub being electrically connected to the coaxial cable on opposite sides of said discontinuity to electrically bridge said gap for signals in a selected range of transmission frequencies, said stub being positioned with a first end of the stub coupled to said gap and having a second end of open circuit impedance transforming to zero impedance at the first end for a range of frequencies about said selected transmission frequency;

whereby the combination enables the coaxial cable to transmit signals in said frequency range while blocking DC and frequencies below said range and thermal energy.

13. The combination of claim 12 wherein the coaxial cable comprises a central conductor and an outer conducting jacket with dielectric material between them.

14. The combination of claim 13 wherein a portion of the outer jacket and a corresponding portion of the coaxial cable dielectric are removed over the length of said gap.

15. The combination of claim 14 wherein the gap is formed with a predetermined gap length.

16. The combination of claim 15 wherein the gap is formed by the removal of said predetermined length of outer jacket.

17. The combination of claim 16 wherein the fabrication of said gap further involves removal of the coaxial cable dielectric material for said predetermined length.

18. The combination of claim 12 wherein said stub comprises an inner sleeve and an outer sleeve with dielectric material between them, the inner sleeve having an inner diameter matching the outer diameter of the jacket and being electrically connected thereto on one side of the gap and the outer sleeve having a necked-down portion with an inner diameter matching the outer diameter of the jacket and being electrically connected thereto on the side of the gap remote from said inner sleeve.

19. The combination of claim 12 wherein the electrical length of said stub is predetermined in accordance with the equation:

$$L=0.075/(f(\in_r)^{0.5})$$

where f is frequency in GHz, $\in_r$ is the dielectric constant of the insulation used in the stub, and L is the stub length in meters.

20. The combination of claim 19 wherein the thickness of the dielectric material in the stub is equal to the length of the gap.

21. The combination of claim 20 wherein the length of the gap is 1.27 mm, the dielectric insulation in the stub is commercially available 7070 glass, and the selected operating frequency is 4 GHz.

22. A coaxial cable assembly with a discontinuous outer jacket, said assembly comprising:

a coaxial cable having a continuous central conductor, an outer conducting sheath, and insulation material disposed therebetween, a section of said coaxial cable having a portion of its outer sheath removed to expose the central conductor along a gap having a selected length; and a stub having an internal conductor, an outer conductor, and a dielectric material separating said internal and outer conductors, said stub having an effective electrical length of a predetermined value;

said outer conductor having a section of enlarged diameter overlapping a portion of said internal conductor and a necked-down section remote from the enlarged diameter section, said overlapped portion of the stub internal conductor and said necked-down section being adapted to match the outer diameter of the coaxial cable outer sheath;

said outer conductor and said internal conductor of the stub being electrically connected to said outer sheath of said coaxial cable on opposite sides of said gap;

whereby said stub is secured in a position along said coaxial cable such that one end of the dielectric material of said stub is positioned over said gap in the coaxial cable.

* * * * *